United States Patent [19]

Foertsch

[11] Patent Number: 4,900,185

[45] Date of Patent: Feb. 13, 1990

[54] ASPHALT SPREADER

[76] Inventor: Gary L. Foertsch, P.O. Box 204, Cabot, Pa. 16023

[21] Appl. No.: 308,547

[22] Filed: Feb. 10, 1989

[51] Int. Cl.[4] ..... E01C 19/48

[52] U.S. Cl. ..... 404/104; 404/105

[58] Field of Search ..... 404/104, 105, 108, 110, 404/111, 96, 101

[56] References Cited

U.S. PATENT DOCUMENTS

| | | | |
|---|---|---|---|
| 2,186,081 | 1/1940 | Slavin | 404/110 |
| 2,403,820 | 7/1944 | Miller | 404/110 |
| 2,899,877 | 8/1959 | Phillips et al. | 404/110 |
| 3,109,351 | 11/1963 | Dunn | 404/104 |
| 3,131,616 | 5/1964 | Gostovich | 404/104 |
| 3,236,163 | 2/1966 | Ackerman et al. | 404/105 X |
| 3,647,096 | 3/1972 | Holland | 404/111 X |
| 4,102,590 | 7/1978 | Zanzie | 404/110 |
| 4,311,408 | 1/1982 | Wren | 404/104 |
| 4,329,081 | 5/1982 | Buvik | 404/110 |
| 4,395,156 | 7/1983 | Sprague | 404/110 |

*Primary Examiner*—Jerome W. Massie
*Assistant Examiner*—Matthew Smith
*Attorney, Agent, or Firm*—Grigsby, Gaca & Davies

[57] ABSTRACT

A three sided spreader box has a pair of columnar members attached to one of its sides. A pair of sleeves slidingly engage the columnar members and allow the spreader box to be coupled to a dump truck having a side delivery conveyor in such a way that the spreader box is held in fixed horizontal relation to the discharge opening of the conveyor but is free to independently move vertically. A road wheel supports the spreader box and provides means for changing the elevation of the bottom edge of the rear wall of the spreader box. Chutework directs asphaltic material from the conveyor into the spreader box. An oiler periodically oils the chute to prevent sticking of the asphaltic material. The rear wall of the spreader may be hinged to allow the inclination from the horizontal of the bottom edge of the rear wall of the spreader box to be varied.

12 Claims, 4 Drawing Sheets

ASPHALT SPREADER

BACKGROUND OF THE INVENTION

This invention relates to devices for the paving of roads and, more particularly, to a device for applying asphaltic material to a road surface or to the shoulder thereof.

Spreader boxes have long been used to resurface roads with asphaltic material or to spread crushed stone or other aggregrate. Such spreader boxes, as for example, those described in U.S. Pat. No. 2,186,081, and U.S. Pat. No. 2,403,820, are generally towed behind a dump truck so that the material to be spread can fall from the dump body into the spreader box and then be spread in a layer that is substantially as wide or wider than the dump body and whose thickness is defined by the height of the bottom of the rear wall of the spreader box above the pre-existing surface. Such spreader boxes provide an efficient means for resurfacing wide stretches of deteriorated road. However, small areas of a roadway, and particularly the edges thereof, often require repair before general resurfacing is called for. Spreader boxes of the type described above are not well suited for the repair of such limited areas of deterioration.

Side delivery conveyors have also been in general use for some time. Such conveyors use endless belts or augers to move material from a dump truck laterally for deposit to one side of the truck's direction of travel. A side delivery conveyor may be used by itself to spread crushed stone or other loose material along the shoulder of a road. However, such a conveyor simply allows the material to fall to the ground and thus cannot, by itself, deposit material in a smooth strip of uniform width, as is required to pave or repair the shoulder of a road with "cold mix" or other asphaltic material. As a result, the paving or repair of a road shoulder normally requires a crew of men with shovels and rakes to lay asphaltic material.

SUMMARY OF THE INVENTION

The present invention provides a three sided spreader box that is adapted for mounting alongside the discharge opening of a side delivery conveyor that is mounted at the rear of a dump truck. The spreader box is mounted in such a way that it can freely move vertically in relation to the conveyor and truck. A road wheel is provided that supports the weight of the box and facilitates its being pulled along with the truck. The road wheel is adjustably attached to one side of the box so that the height of the box, and so the average thickness of the strip of material being laid, can be adjusted. Chutework is provided to direct material from the discharge opening of the conveyor into the spreader box. Means are also provided to lubricate the chutework to prevent the asphaltic material from sticking to it. A removable baffle is provided that can reduce the effective width of the spreader box and thus reduce the width of the strip of material being laid. The rear wall of the spreader box may be hinged so that the bottom edge of the rear wall, and thus the surface of the strip of material being laid, can be inclined from the horizontal.

It is an object of this invention to provide a lightweight spreading device for spreading asphaltic material from a dump truck along the shoulder of a road or in other restricted areas.

It is a further object of this invention to provide a device that can lay a strip of material completely outside the path of travel of the vehicle from which the material is being spread. This will permit the laying of material in areas in which the vehicle cannot conveniently be driven. It has the further advantage of allowing the drive of the vehicle to fully visualize the laying of the strip.

Another object of this invention is to provide a device that can lay strips of asphaltic material of differing thickness and widths and having top surfaces inclined from the horizontal to differing degrees.

Still another object of this invention is to provide an asphalt spreading device that can be quickly and easily be taken out of service and be transported on the truck and side delivery conveyor with which it is used without unduly interfering with other uses of either.

Other objects and purposes of the invention will be clear from the description of the preferred embodiments.

DESCRIPTION OF THE PREFERRED EMBODIMENTS

Figure 1:
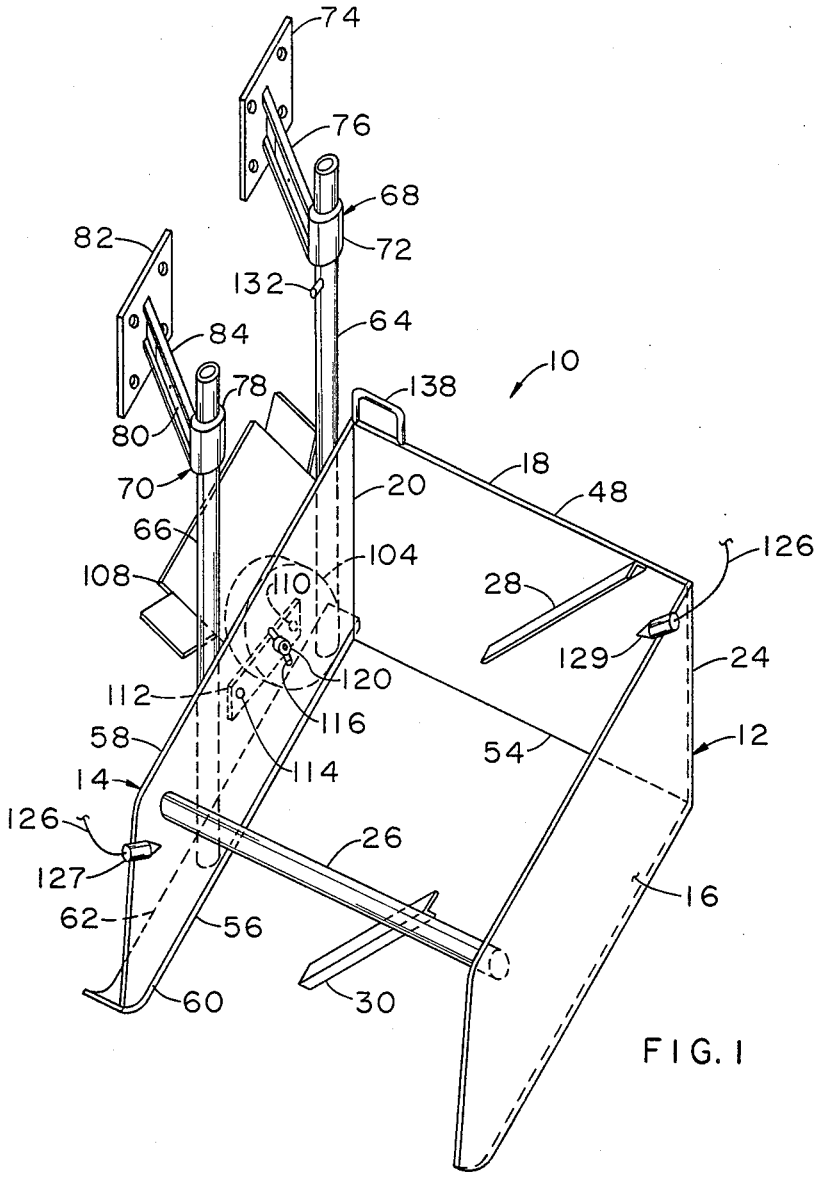
FIG. 1 is an isometric view of one embodiment of the asphalt spreader

Referring to the drawings, FIG. 1 shows an sphalt spreader generally designated 10. The spreader 10 includes a spreader box 12 which is comprised of a first side wall 14, a second side wall 16, and a back wall 18. The side walls 14 and 16 are connected at their rear edges (20 and 24 respectively) by the rear wall 18. The side walls 14 and 16 are connected near the front by a bar 26. Sections of angle iron 28 and 30 are welded to back wall 18 and bar 26 respectively at a slope so as to support a removable baffle, which is shown in FIG. 2.

Figure 2:
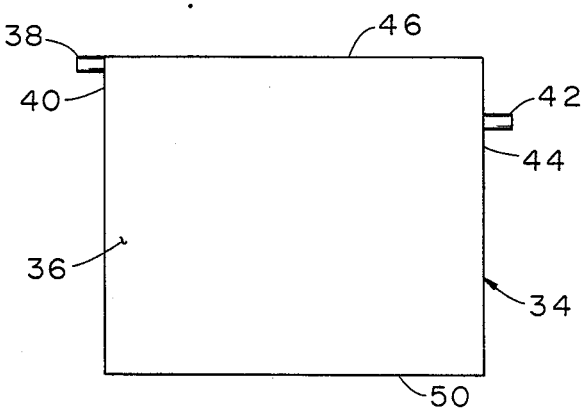
FIG. 2 is a plan view of the removable baffle that may be used in conjunction with the asphalt spreader.

FIG. 2 shows the removable baffle, generally designated 34, comprising a rectangular plate 36 having a first stop 38 projecting from the first side edge 40 and a second side stop 42 projecting from the second edge 44. The width of the plate 36 (i.e. the distance between the first side edge 40 and the second side edge 44) is such that it can be supported by the angle irons 28 and 30 shown in FIG. 1. The stop 38 (which is a section of small diameter bar welded to the plate 36) is located near the top edge 46 of plate 36 and is intended to engage the top 48 of back wall 18 (shown in FIG. 1). The stop 42 is similar to stop 38 but is attached to edge 44 at a height such that it will engage the top of bar 26 when the plate 34 is supported by the angle irons 28 and 30 and stop 38 is engaging the top edge 48 of back wall 18. The length of plate 36 (i.e. the distance between the top edge 46 and the bottom edge 50) is such that, when the baffle is supported by the angle irons 28 and 30 with the stops 38 and 42 engaged as described above, the bottom edge 50 will be level with the bottom edge 54 of the back wall 18 and top edge 46 of the baffle 34 will be substantially level with the top 48 of the back wall 18. As will be made more clear from the later description of the operation of the invention, when the baffle 34 is in place the width of the strip of material laid will be equal to the distance from the bottom edge 50 of the baffle 34 to the bottom edge 56 of the first side wall 14.

Figure 3:
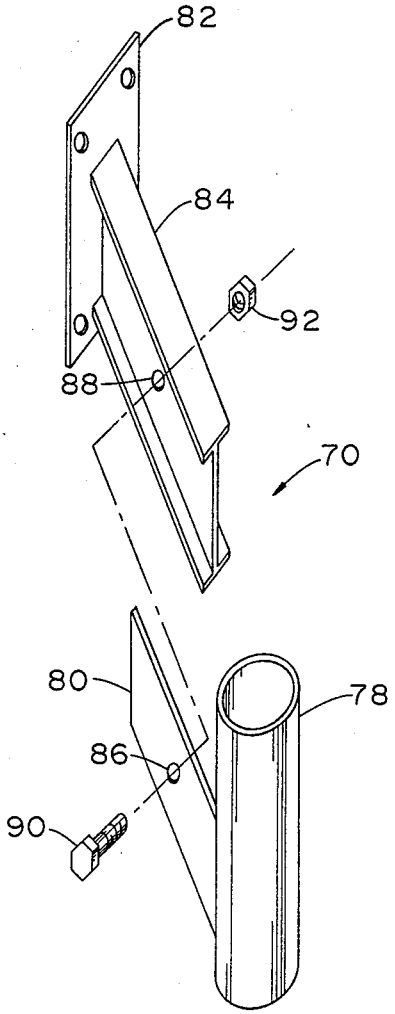
FIG. 3 is an isometric view of one of the brackets used to couple the spreader box to a dump truck.

In the embodiment shown in FIG. 1, the first side wall 14 is comprised of a plate 58 having a strip 60 welded to the bottom thereof. The plate 58 and strip 60 form a flat vertical surface inside the spreader box 12. On the outside however, the strip 60 provides a ledge 62 on which are mounted a first pipe (or similar columnar member) 64 and second pipe 66. The pipes 64 and 66 are welded to the ledge 62 and the plate 58 and, in conjunction with the brackets 68 and 70 are used to couple the spreader box 12 to a side delivery conveyor (not shown in FIG. 1). Bracket 68 is comprised of a sleeve 72 which slidingly engages pipe 64, a mounting plate 74 and a web 76 connecting sleeve 72 to mounting plate 74. As is shown in more detail in FIG. 3, bracket 70 is comprised of a sleeve 78 (which slidingly engages pipe 66) to which is attached a first web 80, and mounting plate 82 to which is attached a second web 84. The webs 80 and 84 have corresponding holes 86 and 88 so that they can be fastened together by bolt 90 and nut 92. When the webs 80 and 84 are so fastened the spreader 10 can be mounted for use in the manner shown in FIG. 4.

Figure 4:
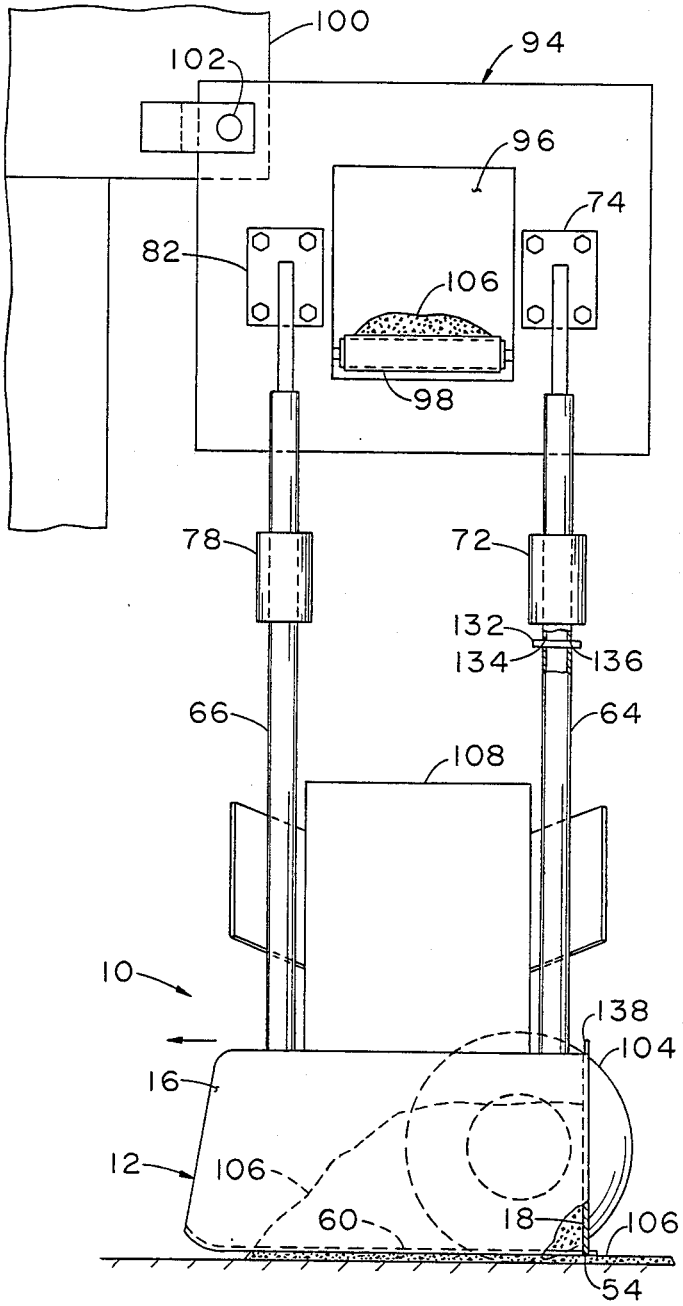
FIG. 4 is an elevation view of the asphalt spreader illustrating its attachment to a dump truck when in use.

FIG. 4 shows a side delivery conveyor 94 having a discharge opening 96 from which material is discharged by means of, for example, an endless belt 98. The conveyor 94 is attached to a dump truck body 100 by means of a hinge 102 so that the conveyor will remain upright when the truck body is inclined to deposit material into the conveyor. Mounting plate 74 is attached to conveyor 94 to the rear of discharge opening 96 and mounting plate 82 is attached to conveyor 94 in front of discharge opening 96. The spreader box 12 is supported by road wheel 104 and is held upright by the pipes 64 and 66, which are slidably engaged by sleeves 72 and 78 respectively. The spreader box 12 is thus coupled to the conveyor 94 in such a manner that it will be drawn along by the dump truck, but is free to move vertically independently.

In operation, asphaltic material 106 falls from the discharge opening 96 of the side delivery conveyor 94 and is directed into the spreader box 12 by chute 108. As the spreader box 12 is drawn forward (to the left in FIG. 4) a strip of asphaltic material 106 is left behind it. The bottom edge 54 of the back wall 18 of the spreader box 12 smooths the surface of the strip of material 106 and establishes its elevation. When the removable baffle 34 is not in place the material 106 is free to fill the entire width of the spreader box 12 (i.e. from the first side wall 14 to the second side wall 16) and the strip of material 106 that is laid will thus have that width. However, when the removable baffle 34 is in place the material 106 is confined to the space between the baffle 34 and the first side wall 14 and the width of the strip laid will be equal to the distance from the bottom edge 50 of baffle 34 to the bottom edge 56 of first side wall 14.

Figure 5:
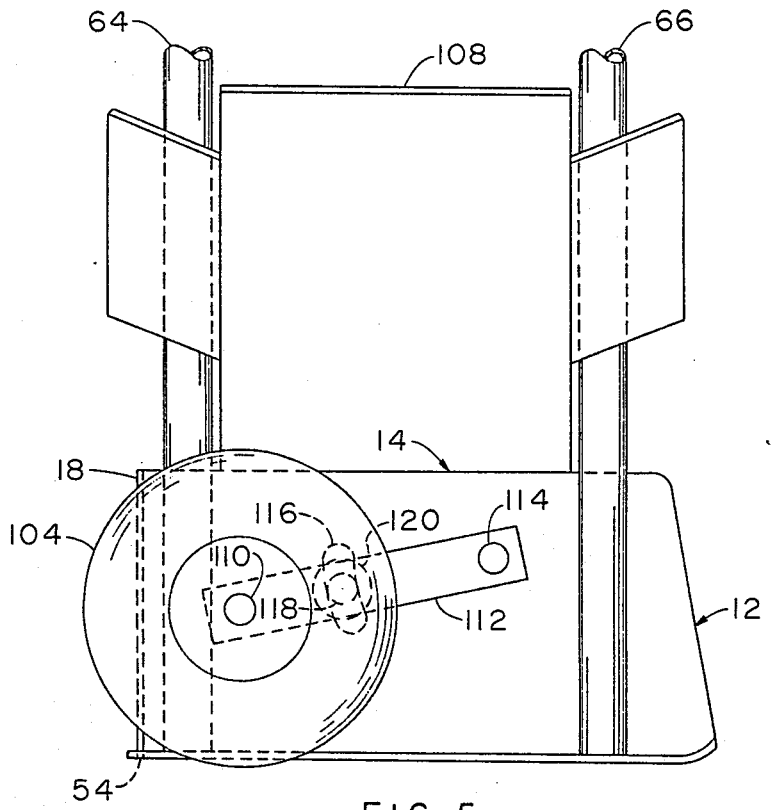
FIG. 5 is an elevation view of the asphalt spreader from the direction opposite that of FIG. 4.

The elevation of the top surface of the strip of material 106 that is spread can be changed by adjusting the elevation of the bottom edge 54 of back wall 18. As is illustrated in FIG. 1 and FIG. 5, the hub 110 of road wheel 104 is rotatably mounted on bar 112. Bar 112 is, in turn, rotatably mounted on pin 114 which is attached to the outside of first side wall 14. A slot 116 comprising a part of the circumference of a circle about pin 114 is cut in side wall 14 and a bolt 118 attached to bar 112 projects through slot 116 into the inside of spreader box 12. When the nut 120 on bolt 118 inside spreader box 12 is tightened against side wall 14, bar 112 is held fixed in relation to the spreader box 12 and the elevation of the bottom edge 54 of back wall 18 above the point at which road wheel 104 will engage the ground is thus held constant. The elevation of bottom edge 54 can be adjusted by loosening nut 120, adjusting the position of bar 112, and then retightening nut 120.

Figure 6:
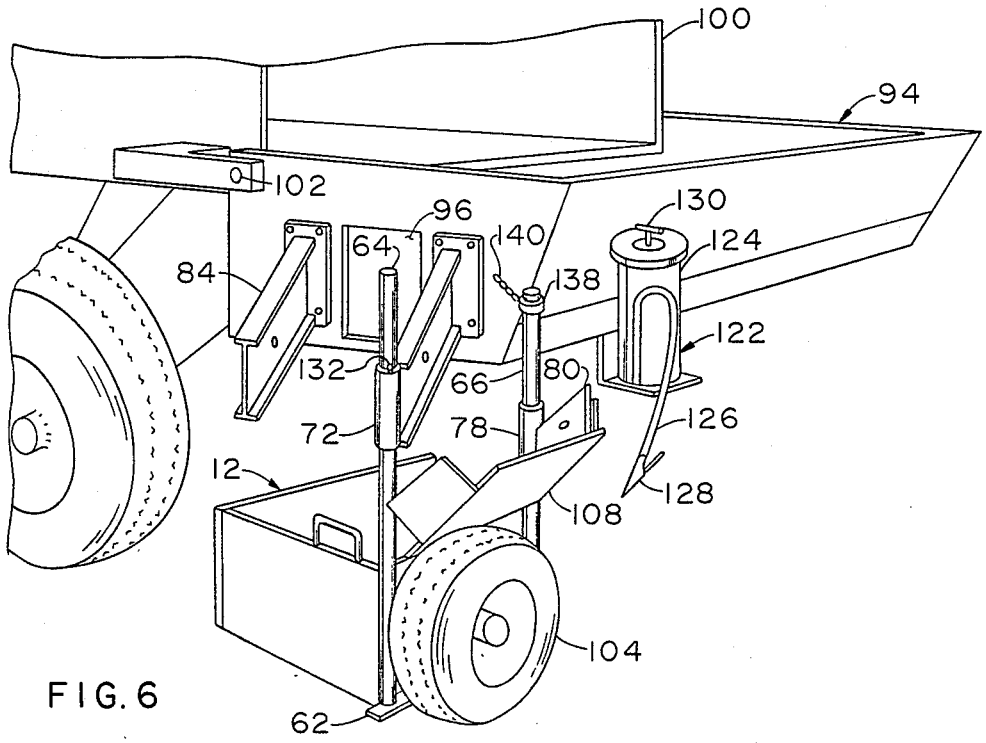
FIG. 6 is an isometric view of the asphalt spreader illustrating its attachment to a dump truck when not in use.

Asphaltic material has a tendency to stick to the chute 108 and the walls 14, 16 and 18. This can be avoided by applying approximately 2 ounces of motor oil, diesel fuel, kerosene or similar lubricant to these surfaces approximately every 4 minutes. An oiler is, therefore, provided. FIG. 6 shows a manual oiler, generally designated 122, comprised of a reservoir 124, a hose 126, a spray nozzle 128, and a pump 130, mounted on the conveyor 94 near the spreader box 12. If manual application of oil is considered to be inconvenient, a pair of oiler nozzles 127 and 129 may be clamped to the spreader box 12 as shown in FIG. 1 so as to provide coverage of the chute 108 and substantially all of the interior of the spreader box 12. It will be understood that it will be necessary to reposition the nozzles 127 and 129 when the baffle 34 is in place.

The asphalt spreader 10 can be taken out of service by removing bolt 90 from holes 86 and 88 in the webs 80 and 84 and removing the pin 132 from the holes 134 and 136 in pipe 64 and then lifting the spreader box 12 by the handle 138 until hole 134 and 136 are above the level of sleeve 72, at which time pin 132 is reinserted in holes 134 and 136 and the handle 138 is lowered until pin 132 rests on sleeve 72. With the spreader box 12 and ground wheel 104 thus suspended, they can be rotated on pipe 64 to the position shown in FIG. 6. A ring 138 attached to side delivery conveyor 94 by a chain 140 is provided to engage pipe 66, thereby holding the spreader box 12 and ground wheel 104 in the position shown in FIG. 6. In this position the asphalt spreader can easily be transported to and from job sites. With the asphalt spreader in this position the truck can also travel on the roadway in a normal manner while using the conveyor 94 in operations requiring the discharge to the right side of the truck (i.e. the side opposite discharge opening 96). In addition, discharge opening 96 can also be used for some other operations while the spreader box 12 is in the position shown in FIG. 6. Also, it is most convenient to have the spreader box 12 in the position shown in FIG. 6 when adjusting the position of the bar 112 and road wheel 104 as described above to change the elevation of the top surface of the material.

Figure 7:
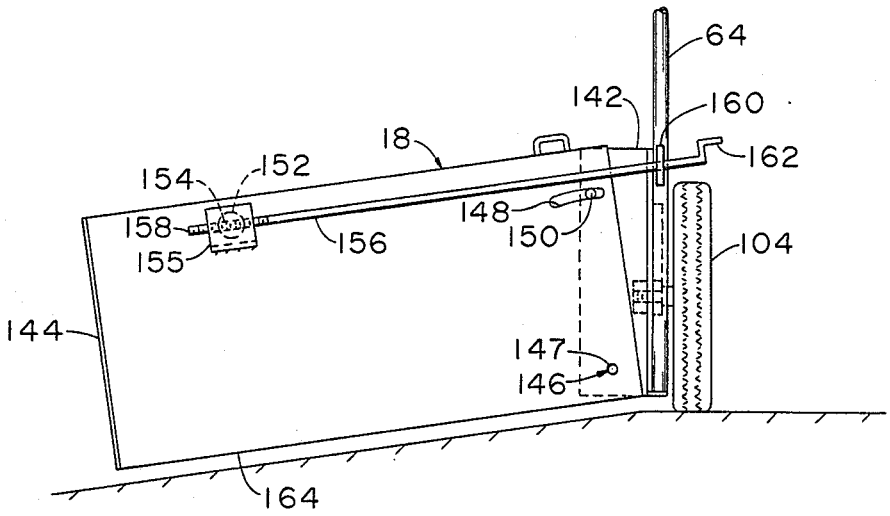
FIG. 7 is an elevation view of a second embodiment of the asphalt spreader as seen from the rear.
Figure 8:
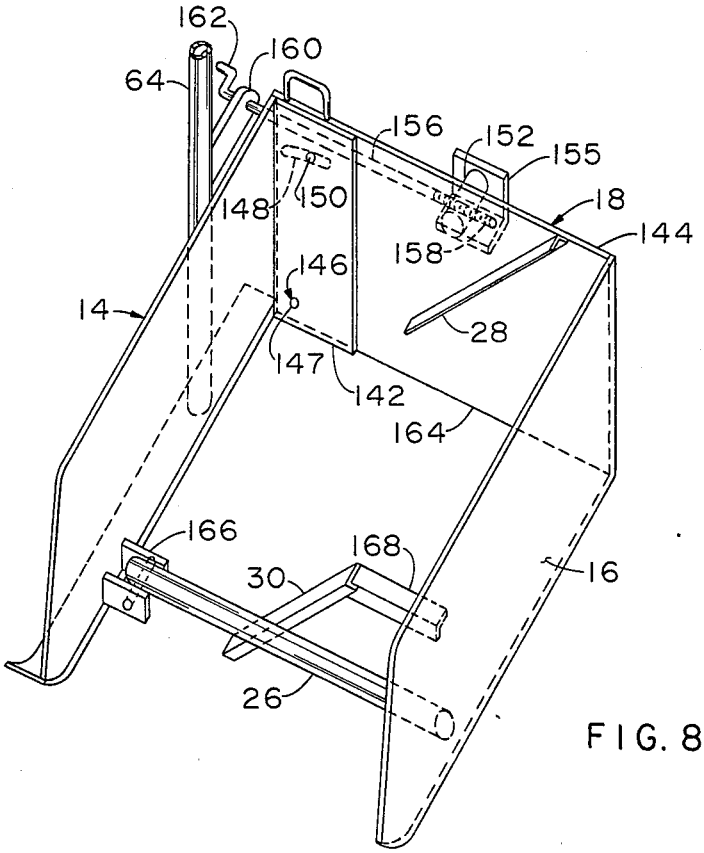
FIG. 8 is an isometric view of a part of the asphalt spreader of FIG. 7.

The shoulder of a road often is sloped away from the main surface of the road in order to facilitate drainage. The embodiment of my invention shown in FIG. 7 and FIG. 8 is particularly well suited to the resurfacing of such shoulders. In this embodiment the back wall 18 is comprised of a short section 142 rigidly attached to first side wall 14 and a long section 144. Back wall sections 142 and 144 are rotatably connected near the bottom by a hinge 146 comprised of a pin 147 through corresponding holes in the two back wall sections. A slot 148 comprising part of the diameter of a circle about hinge 146 is cut in back wall section 144 near the top thereof. A pin 150 is rigidly attached to back wall section 142 and projects through slot 148 to provide support for back wall section 144.

A short bar section 152 having a transverse threaded hole 154 therethrough is rotatably attached to the outside of back wall section 144 by means of bracket 155. Bar 152 is located on the side of slot 148 away from side wall 14. A smaller diameter bar 156 has a threaded end 158 engaged in the threaded hole 154 in bar 152. Bar 156 is supported near its other end by bracket 160, which is attached to pipe 64. Bracket 160 allows bar 156 to rotate about its axis, but does not allow it to move in a direction parallel to its axis. Therefore, rotation of bar 156 by means of handle 162 will cause back wall section 144 to rotate about hinge 146, thereby altering the inclination from the horizontal of the bottom edge 164 of back wall section 144.

In the embodiment shown in FIG. 7 and FIG. 8 the bar 26 connecting side walls 14 and 16 is attached to side wall 14 by means of clevis 166 so as to allow the inclination from the horizontal of bar 26 to vary along with the inclination of bottom edge 164 of back wall section 144. Clevis 166 is located such that the axis of rotation of bar 26 about clevis 166 coincides with the axis of rotation of rear wall section 144 about hinge 146. This permits bar 26 and rear wall section 144, which are rigedly connected by side wall 16, to turn on a common axis. Because bar 26 is positioned substantially lower than in the embodiment shown in FIG. 1, the top of angle iron 30 is braced by support 168, which is comprised of a section of angle iron welded to angle iron 30 and to side wall 16. Except for these and the other differences that have been pointed out, the two embodiments of my invention described above are identical to each other.

For the resurfacing of road shoulders I have found it desirable to use a spreader of the type described above having a bottom edge 54 of the rear wall 18 approximately 55.88 cm. (22 inches) long and sides 14, 16 and 18 all approximately 31.75 cm. (12 inches) high. I have also found it useful to locate the angle irons 28 and 30 such that use of the removable baffle will reduce the width of the strip of material being laid to approximately 31.75 cm (12 inches.) These dimension can, of course, be varied to accommodate the anticipated use of the device. Many other changes and modifications in the above-described embodiments of the invention can also be carried out without departing from the scope thereof.

I claim:

1. An asphalt spreading device for use with a vehicle having a side delivery conveyor, said spreading device comprising;

a. a spreader box comprising a first side wall, a second side wall spaced apart from the first side wall and substantially parallel thereto, and a back wall connecting the first side wall and the second side wall;

b. a road wheel, c. means for attaching the road wheel to the side of the first side wall away from the second side wall in such a manner that the elevation of the bottom of the road wheel in relation to the bottom of the back wall can be adjusted, and d. means for holding the spreader box in fixed horizontal relation and variable vertical relation to the discharge opening of a side delivery conveyor.

2. A device according to claim 1 having chute means for directing asphaltic material from the discharge opening of the side delivery conveyor into the spreader box.

3. A device according to claim 2 having means for applying oil to the chute means.

4. A device according to claim 1 having baffle means removably disposed between the first side wall and the second side wall so as to partition the space therebetween.

5. A device according to claim 1 in which the means for holding the spreader box in fixed horizontal relation and variable vertical relation to the discharge opening of a side delivery conveyor comprises;

a. a plurality of columnar members attached to the spreader box, b. a plurality of sleeves, each of which slidingly engages one of the columnar members, and c. means for attaching the sleeves to a side delivery conveyor.

6. A device according to claim 1 in which the means for holding spreader box in fixed horizontal relation and variable vertical relation to the discharge opening of a side delivery conveyor comprises;

a. a plurality of columnar members attached to the spreader box, b. a plurality of sleeves, each of which slidingly engages one of the columnar members, and c. means for attaching the sleeves to a vehicle having a side delivery conveyor.

7. A device according to claim 1 in which the back wall of the spreader box is hinged such that the inclination from the horizontal of at least a part of the bottom edge of the back wall can be varied.

8. A device according to claim 7 having chute means for directing asphaltic material from the discharge opening of the side delivery conveyor into the spreader box.

9. A device according to claim 8 having means for applying oil to the chute means.

10. A device according to claim 7 having baffle means removably disposed between the first side wall and the second side wall so as to partition the space therebetween.

11. A device according to claim 7 in which the means for holding the spreader box in fixed horizontal relation and variable vertical relation to the discharge opening of a side delivery conveyor comprises;

a. a plurality of columnar members attached to the spreader box, b. a plurality of sleeves, each of which slidingly engages one of the columnar members, and c. means for attaching the sleeves to a side delivery conveyor.

12. A device according to claim 7 in which the means for holding the spreader box in fixed horizontal relation and variable vertical relation to the discharge opening of a side delivery conveyor comprises;

a. a plurality of columnar members attached to the spreader box, b. a plurality of sleeves, each of which slidingly engages one of the columnar members, and c. means for attaching the sleeves to a vehicle having a side delivery conveyor.

* * * * *